United States Patent [19]

Goodchild

[11] 4,051,991

[45] Oct. 4, 1977

[54] STAPLER ATTACHMENT

[75] Inventor: Harry M. Goodchild, Worcester, Mass.

[73] Assignee: Parker Manufacturing Company, Worcester, Mass.

[21] Appl. No.: 743,280

[22] Filed: Nov. 19, 1976

[51] Int. Cl.[2] ..... B25C 7/00

[52] U.S. Cl. ..... 227/155; 227/132; 227/156

[58] Field of Search ..... 227/108, 132, 155, 156

[56] References Cited

U.S. PATENT DOCUMENTS

| | | | |
|---|---|---|---|
| 911,676 | 2/1909 | Pearson | 227/108 |
| 1,655,275 | 1/1928 | La Place | 227/132 |
| 1,855,178 | 4/1932 | Bliss et al. | 227/155 |
| 2,378,725 | 6/1945 | Paul | 227/155 |
| 2,687,522 | 8/1954 | Juilfs | 227/155 |
| 2,862,712 | 1/1975 | La Pointe et al. | 227/132 |

*Primary Examiner*—Granville Y. Custer, Jr.
*Attorney, Agent, or Firm*—Norman S. Blodgett; Gerry A. Blodgett

[57] ABSTRACT

Attachment for converting a stapler for driving open staples into a stapler for driving closed staples, the attachment including a plate having a first portion which is clamped to the base of the stapler and a resilient second portion which extends a substantial angle to the first portion and carries a staple-bending device.

9 Claims, 5 Drawing Figures

STAPLER ATTACHMENT

BACKGROUND OF THE INVENTION

The development of staplers and stapling guns over the years has resulted in two distinct types. The first group are the so-called "office staplers" which are normally used for stapling papers together with a closed staple. The second group, commonly known as "construction staplers", drive an open staple into wood or the like. The office stapler usually uses a light weight staple with very little force and is generally useless in fastening together materials like cardboard. The construction stapler, on the other hand, drives a heavy duty staple with considerable force, but also cannot be used to provide a closed staple in fastening cardboard and the like together. Quite often, the base of an office stapler is hinged to permit it to be used for driving the light staples without closing them. In the case of the heavy duty stapler, however, there is no provision for bending the staple. Nevertheless, there are occasions when it would be desirable to use such a heavy-duty staple for fastening sheet materials together, either because they are tough (like cardboard) or because the thickness of the stack of papers is so great. These and other difficulties experienced with the prior art devices have been obviated in a novel manner by the present invention.

It is, therefore, an outstanding object of the invention to provide an attachment for use with a heavy-duty stapler to cause the staples to be closed.

Another object of this invention is the provision of an attachment for an industrial stapler which may be selectively placed on the stapler or removed from it.

A further object of the present invention is the provision of a stapler attachment which is simple in construction, which is inexpensive to manufacture, and which is capable of a long life of useful service.

It is another object of the instant invention to provide a stapler assembly capable of furnishing a wide gap for the introduction of materials, which gap is closed around the material when the staple is driven.

A still further object of the invention is the provision of a stapler attachment in which the staple-bending device is mounted on a resilient plate which extends at a substantial angle to the base of the stapler when the stapler is held in the hand and is pressed to a much smaller angle when the stapler is pressed against a surface.

It is a further object of the invention to provide an attachment for a stapling gun which is not readily dislodged during use.

With these and other objects in view, as will be apparent to those skilled in the art, the invention resides in the combination of parts set forth in the specification and covered by the claims appended hereto.

SUMMARY OF THE INVENTION

In general, the invention consists of an attachment for a stapler having an elongated main body with an exit from which the staples are driven in open condition and having an elongated staple storage compartment which extends at a right angle to the main body. The attachment is provided with an elongated plate adapted to lie under the storage compartment and a pair of spaced parallel arms extending upwardly from the plate for embracing the storage compartment. A staple-bending device is mounted on the plate in line with the exit opening in the main housing.

More specifically, the plate has a first portion that contacts the undersurface of the storage compartment and carries the arms, as well as a second portion that normally lies at an acute angle to the first portion and carries the staple-bending device. The first portion, the second portion, and the arms are integrally formed of a resilient material, so that the arms and the second portion can bend relative to the first portion. The staple-bending device is separately formed of a hard, wear-resistant material and has a transversely-elongated bending pocket. The end of the second portion farthest away from the first portion is provided with a pair of spaced, parallel flanges which resiliently embrace the staple-bending device. The arms are provided with inwardly-directed lugs that lock over inwardly-directed recesses on the sides of the storage compartment. These recesses are defined by a U-shaped staple track which is slidable along the storage compartment and has side walls which lie against corresponding side walls of the storage compartment and have upper edges that are spaced downwardly from the top of the storage compartment to define the recesses.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
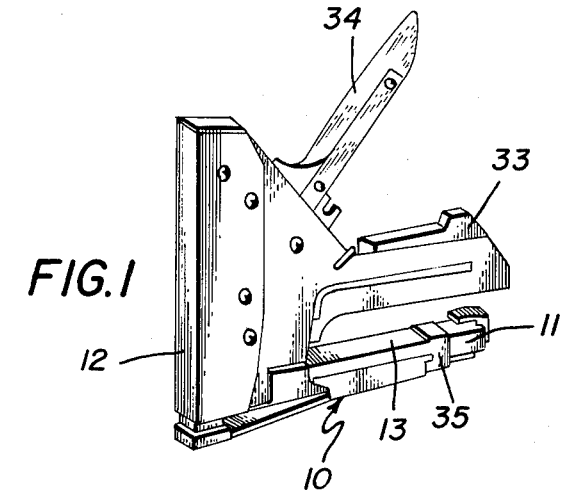
FIG. 1 is a perspective view of a stapler attachment embodying the principles of the present invention.
Figure 2:
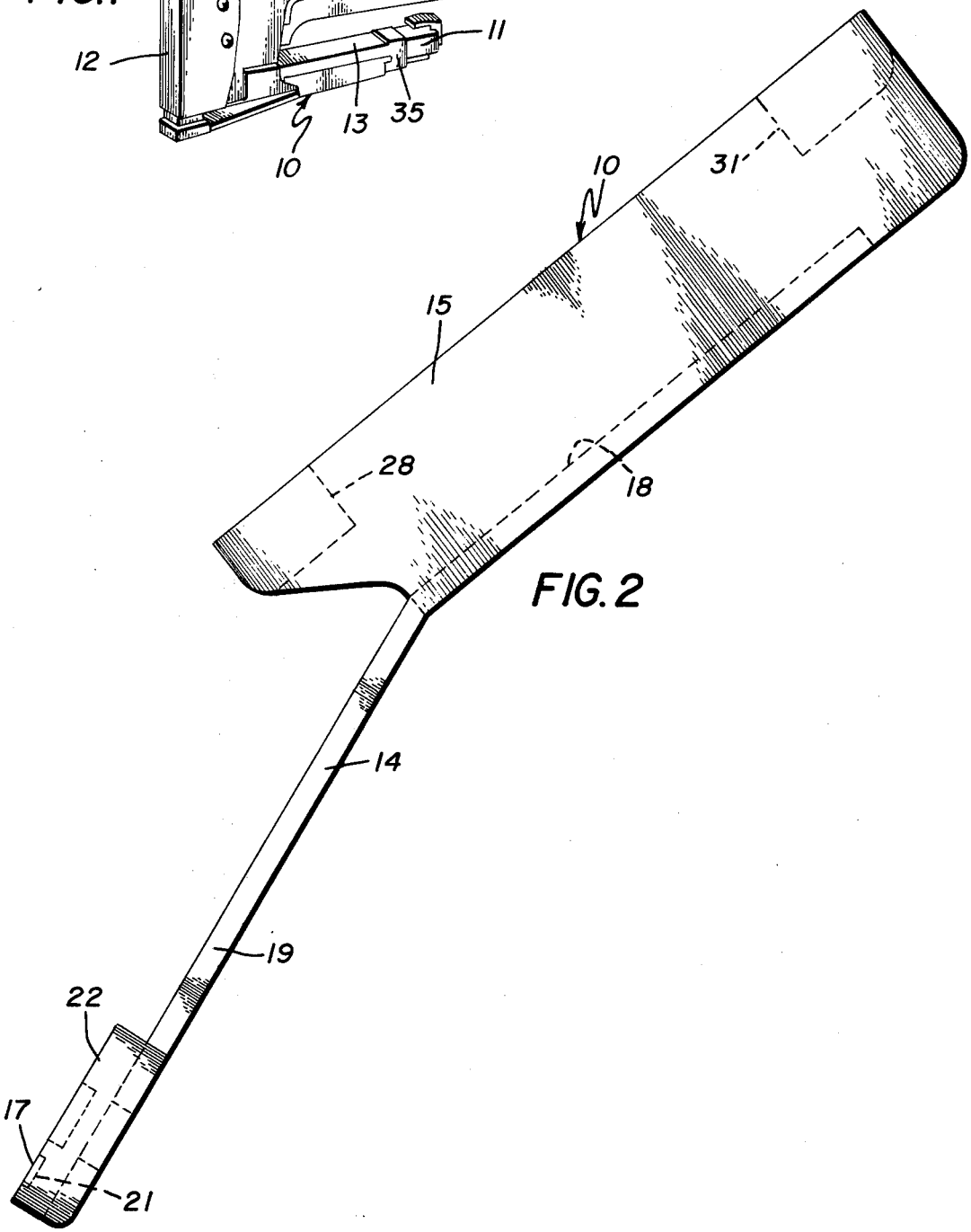
FIG. 2 is an elevational view of the attachment.
Figure 3:
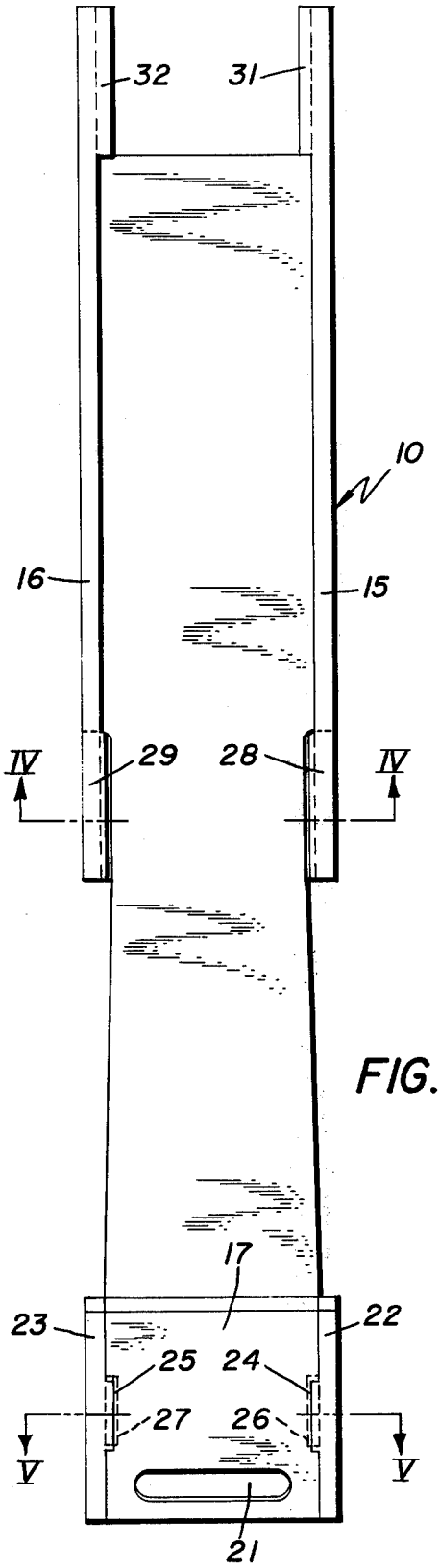
FIG. 3 is a plan view of the attachment.
Figure 4:
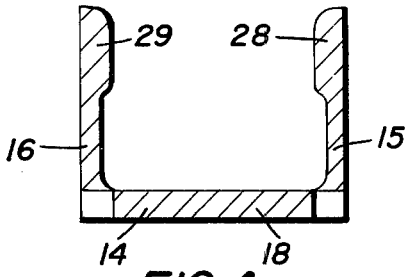
FIG. 4 is a sectional view of the attachment taken on the line IV—IV of FIG. 3.

Referring first to FIG. 1, wherein are best shown the general features of the invention, the stapler attachment, indicated generally by the reference numeral 10, is shown in use with stapling gun or stapler 11. The stapler is of the type shown and described in the patent of LaPointe U.S. Pat. No. 3,862,712 and is shown as having an elongated main housing 12 with an elongated staple storage compartment extending at a right angle from one end.

Referring to FIGS. 2 through 5, the attachment 10 is provided with an elongated, flat plate 14 adapted to underlie and extend along the under-surface of the storage compartment 13. A pair of spaced parallel arms 15 and 16 are connected to the plate 14 in line with the exit opening in the main housing 12 from which the staples emerge.

The plate 14 consists of a first straight portion 18, extending under the storage compartment and carrying the arms 15 and 16, and a second straight portion 19 which is connected to and lies at an acute angle to the first portion, while carrying the staple-bending device at its outer end. The first portion 18, the second portion 19, and the arms 15 and 16 are formed of an elastomer material which, in the preferred embodiment, is a resilient grade of polyvinyl chloride, so that the second portion and the arms are capable of being resiliently bent relative to the first portion.

Figure 5:
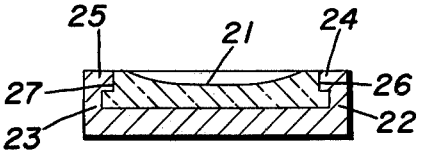
FIG. 5 is a sectional view of the attachment taken on the line V—V of FIG. 3.

As is best evident in FIG. 5, the staple-bending device 17 is formed separately of the rest of the accessory of a hard, wear-resistant material (which in the preferred embodiment is a powdered metal, such as pressed and sintered powdered iron), and is provided with a transversely-extending bending pocket 21. The end of the second portion 19 furthest away from the connection to the first portion 18, is provided along its side edges with two spaced, parallel, upwardly-extending flanges 22 and 23 which resiliently embrace the staple-bending device 17. These flanges 22 and 23 are provided with inwardly-directed lugs 24 and 25, respectively, and the staple-bending device 17 is correspondingly provided with recesses 26 and 27 for engagement by the lugs.

The arms 15 and 16, which extend upwardly from the first portion 18 of the plate, extend lengthwise of the attachment a substantial distance and, in the preferred embodiment, this distance is approximately one-half its entire length. The forward corners of the arms are provided with inwardly-directed lugs 28 and 29, while the rear corners are provided with inwardly-directed lugs 31 and 32. The lower edges of these lugs fit snugly over the lower edge of recesses formed on either side of the storage compartment 13 of the stapler. These recesses in the sides of the storage compartment extend lengthwise along a major portion of its length and the first portion of the plate and the arms extend along it the same distance.

As is best evident in FIG. 1, in the preferred embodiment, the stapler 11 is constructed so that a grip handle 33 extends away from the central portion of the main housing 12 and an operating handle 34 is pivotally mounted on the main housing. Carried on the storage compartment 13 is a staple track 35, which is shown in detail in the above-mentioned U.S. Pat. No. 3,862,712. The storage compartment 13 has a box-like cross-section with an upper wall and downwardly-extending side walls. The staple track 35 has a U-shaped cross-section and is slidable along the compartment for loading staples and feeding them toward the exit opening. The staple track has a bottom wall which underlies the compartment and has upwardly-directed side walls that embrace the side walls of the storage compartment. The side walls of the track have upper edges of the side walls of the track and the side walls of the compartment. As is evident in FIG. 4, the upper edges of the lugs 28, 29, 31, and 32 are rounded to allow them to snap up over the side walls of the staple track and enter the recesses.

The operation and advantages of the above invention will now be readily understood in view of the above description. The stapler 11 is capable, of course, of driving heavy-duty staples directly into material such as wood, usually for the purpose of attaching thinner materials to it; for instance it is used in fastening construction-type polyethylene sheet to frame materials to enclose a space against the wind. It cannot be used, however, to fasten one sheet of thin material to another such sheet, unless the two sheets are both fastened to a substructure into which the staple is driven. In order to staple two thin sheets of cardboard or plastic together with the stapler, it is possible to use the accessory of the present invention. In order to assemble the accessory on the stapler, the upper edges of the arms 15 and 16 are pressed upwardly against the staple track 35. Because of the rounded nature of the upper portions of the lugs 28, 29, 31, and 32, the resilient arms are forced apart, so that the lugs are able to slide up the sides of the staple track. Eventually the upper surface of the first portion 18 of the plate 14 contacts the bottom wall of the staple track. At that time the lugs have snapped over the upper edge of the side walls of the staple track and reside in the recesses with the upper surface of the first portion 18 held firmly against the undersurface of the staple track. The second portion 19 resides at an acute angle to the bottom of the accessory. When the stapler with the accessory mounted on it rests on a horizontal surface, such as a table, this angle is reduced somewhat, because of the natural resilience of the material of which the accessory is made.

Even though the angle between the second portion 19 and the bottom of the stapler has been somewhat reduced, a substantial gap still exists for the insertion of the sheets which are to be fastened together. The sheets are placed between the opening at the bottom the main housing 12 (from which the staples emerge) and the staple-bending device 17. The user then grasps the grip handle 33 and the operating handle 34 in his hand and begins to squeeze the operating handle toward the grip handle while pressing downward on the stapler. The downward pressure of the stapler bends the second portion 19 further upwardly, so that the staple-bending device 17 is moved upwardly toward the bottom of the stapler. The sheets are clamped in this way between the staple-bending device and the bottom of the stapler. Eventually, the operating handle is pressed toward the grip handle sufficiently to cause firing of the stapler and a heavy-duty staple is driven from the opening at the bottom of the main housing. The legs of the staple pierce the sheets which are to be fastened together and come in contact with the surface of the pocket 21 formed in the upper surface of the staple-bending device 17. Because of the curved nature of the pocket, the legs of the staple are bent inwardly and are pressed tightly on the undersurface of the material to be stapled. It can be seen, then, that the present invention is particularly useful in the construction field in which the stapler 11 would normally be used for driving into a wooden structure, but in which occasional use in fastening sheet materials together occurs. For instance, it is sometimes necessary to join long strips of construction polyethylene sheets together. It can also be used in an office where heavy-duty stapling very seldom occurs, so that it is not desirable to purchase a heavy-duty office stapler. In that case, one of the members of the office staff can bring his home workshop stapler to the office and use it with the accessory for that occasional heavy-duty stapling operation. The attachment is very simple and rugged and, because of its elastomer nature, can be subjected to a considerable amount of abuse. For instance, it can be carried in a tool box with miscellaneous tools and material and, yet, will always be in condition for the occassional use to which it would be put.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Stapler assembly, comprising a. a main housing having a grip handle and an operating handle, b. an elongated staple storage compartment underlying the main body and extending in the same general direction as the grip handle, the compartment having a box-like cross-section with an upper wall and side walls, c. a U-shaped staple track slidable along the compartment for loading staples and having a bottom wall which underlies the compartment and upwardly-directed side walls that embrace the side walls of the compartment, the side walls of the track having upper edges that lie substantially below the said upper wall of the compartment, so that a recess is formed by the said upper edge of the track and the side walls of the compartment, and d. an attachment formed of an elastomer material and having a first portion lying against the bottom wall of the track with a pair of arms embracing the side walls of the track, the arms having inwardly-directed lugs that reside in the said processes, the attachment having a second portion that lies at an acute angle to the first portion and, carries a staple-bending device in a position underlying the main housing.

2. Stapler having an elongated main housing and an elongated staple storage compartment extending at a right angle thereto, comprising a. an elongated plate adapted to underlie the storage compartment, the plate having a first portion extending along the undersurface of the storage compartment and a resilient second portion that normally lies at an acute angle to the first portion, and b. a staple-bending device mounted on the second portion of the plate in line with the main housing.

3. Attachment for stapler having an elongated main housing and an elongated staple storage compartment extending at a right angle thereto, comprising:

a. an elongated plate adapted to underlie the storage compartment, b. a pair of arms connected to the plate to embrace the storage compartment, and c. a staple-bending device mounted on the plate and located in line with the main housing, the plate having a first portion that contacts an undersurface of the storage compartment and carries the arms, as well as a second portion that normally lies at an acute angle to the first portion and carries the staple-bending device.

4. Attachment as recited in claim 1, wherein the first portion, the second portion, and the arms are integrally formed of a resilient material, so that the arms and the second portion can bend relative to the first portion.

5. Attachment as recited in claim 4, wherein the staple-bending device is separately formed of a hard, wear-resistant material and has a transversely-elongated bending pocket.

6. Attachment as recited in claim 5, wherein the end of the second portion away from the first portion is provided with a pair of spaced, parallel flanges which resiliently embrace the staple-bending device.

7. Attachment as recited in claim 6, wherein the flanges are provided with inwardly-directed lugs and the staple-bending device is provided with corresponding recesses for engagement by the lugs.

8. Attachment for stapler having an elongated main housing and an elongated staple storage compartment extending at a right angle thereto, comprising:

a. an elongated plate adapted to underlie the storage compartment, b. a pair of arms connected to the plate to embrace the storage compartment, and c. a staple-bending device mounted on the plate and located in line with the main housing, the arms being provided with inwardly-directed lugs that lock over inwardly-directed recesses an the sides of the storage compartment.

9. Attachment as recited in claim 8, wherein the recesses in the sides of the storage compartment extend lengthwise along it a major portion of its length and the first portion of the plate and the arms extend along it the same distance.

* * * * *